US006823851B2

(12) United States Patent
Amano et al.

(10) Patent No.: US 6,823,851 B2
(45) Date of Patent: Nov. 30, 2004

(54) FUEL VAPOR PROCESSING DEVICE FOR INTERNAL COMBUSTION ENGINE

(75) Inventors: Noriyasu Amano, Gamagori (JP); Hideaki Itakura, Nagoya (JP); Naoya Kato, Ama-gun (JP); Masao Kano, Gamagori (JP)

(73) Assignees: Nippon Soken, Inc., Nishio (JP); Denso Corporation, Kariya (JP)

( * ) Notice: Subject to any disclaimer, the term of this patent is extended or adjusted under 35 U.S.C. 154(b) by 34 days.

(21) Appl. No.: 10/351,377

(22) Filed: Jan. 27, 2003

(65) Prior Publication Data

US 2003/0140901 A1 Jul. 31, 2003

(30) Foreign Application Priority Data

Jan. 31, 2002 (JP) ..... 2002-24418

(51) Int. Cl.[7] ..... F02M 25/09
(52) U.S. Cl. ..... 123/520
(58) Field of Search ..... 123/516, 518, 123/519, 520, 557

(56) References Cited

U.S. PATENT DOCUMENTS 5,377,644 A * 1/1995 Krohm ..... 123/520
6,230,693 B1 * 5/2001 Meiller et al. ..... 123/519
6,279,548 B1 * 8/2001 Reddy ..... 123/520
2002/0174857 A1 * 11/2002 Reddy et al. ..... 123/520

FOREIGN PATENT DOCUMENTS

| | | |
|---|---|---|
| JP | A-63-150459 | 6/1988 |
| JP | A-63-215864 | 9/1988 |
| JP | A-6-74068 | 3/1994 |
| JP | U-7-22059 | 4/1995 |
| JP | A-2001-182632 | 7/2001 |

* cited by examiner

*Primary Examiner*—Thomas Moulis
(74) *Attorney, Agent, or Firm*—Nixon & Vanderhye P.C.

(57) ABSTRACT

When purge control of fuel vapor, which is released from a fuel tank and is then adsorbed and retained in a fuel adsorption layer of a canister, is performed through ON/OFF control of a purge valve, ON/OFF of a heater plate received in the canister is controlled based on a purge fuel vapor concentration estimated through air-fuel ratio control operation of an engine. In this way, a sensor for measuring the purge fuel vapor concentration of the fuel vapor conducted from the canister to an intake passage of the engine can be eliminated.

6 Claims, 9 Drawing Sheets

FUEL VAPOR PROCESSING DEVICE FOR INTERNAL COMBUSTION ENGINE

CROSS REFERENCE TO RELATED APPLICATION

This application is based on and incorporates herein by reference Japanese Patent Application No. 2002-24418 filed on Jan. 31, 2002.

BACKGROUND OF THE INVENTION

1. Field of the Invention

The present invention relates to a fuel vapor processing device of an internal combustion engine, which adsorbs fuel vapor vaporized in a fuel tank into a canister and then purges it by discharging it into an intake passage of the internal combustion engine based on a current operational state of the internal combustion engine.

2. Description of Related Art

A previously proposed fuel vapor processing device of an internal combustion engine uses a canister filled with activated carbon as the adsorption material to adsorb and retain fuel vapor vaporized in a fuel tank while a vehicle is running or stopped to substantially restrain release of the fuel vapor from the vehicle to the atmosphere. The fuel vapor temporarily adsorbed and retained in the canister is desorbed by outside air, which is suctioned into the canister through a canister atmosphere communicating orifice by a vacuum developed in the intake passage upon operation of the internal combustion engine. Then, the desorbed fuel vapor is discharged into the intake passage. Thereafter, the fuel vapor is mixed with air introduced into the intake passage together with fuel injected by an injector (fuel injection valve) to form a predetermined air-fuel mixture, which is then supplied into a combustion chamber in the internal combustion engine for combustion.

In recent years, regulations regarding discharging fuel vapor into the atmosphere are being tightened. For example, the ORVR (Onboard Refueling Vapor Recovery) regulation requires that fuel vapor escaping from the fuel tank during refueling is completely captured in a canister without discharging it into the atmosphere. Therefore, a large amount of fuel vapor must be processed in the canister, creating a demand for a canister with better performance. The adsorption and desorption performance of activated carbon is greatly affected by temperature. That is, the adsorbed fuel amount increases as the temperature drops, and the desorbed fuel amount increases as the temperature rises. Furthermore, the canister interior temperature rises during adsorption, and the canister interior temperature falls during desorption. Thus, the activated carbon performance is not fully realized.

Japanese Unexamined Patent Publication No. 2001-182632 discloses a fuel vapor processing device that addresses this problem to improve desorption performance. In the fuel vapor processing device, a heater is arranged on an exterior wall of the canister or in the center of the canister to heat the activated carbon during desorption of the adsorbed fuel from the canister. Although a temperature range for achieving an effective result of temperature adjustment is considered, a structure of the fuel vapor processing device is disadvantageously complicated, and a cost of the fuel vapor processing device is disadvantageously increased due to the use of an HC concentration sensor for monitoring a concentration of purge fuel vapor (purge gas) and a temperature sensor in the heater temperature adjustment control process.

SUMMARY OF THE INVENTION

The present invention addresses these disadvantages. Thus it is an objective of the present invention to provide a fuel vapor processing device for an internal combustion engine, which has a simple structure and is capable of performing favorable fuel vapor processing without using an HC concentration sensor to monitor the purge fuel vapor (purge gas) concentration in heater temperature adjustment control process.

To achieve the objective of the present invention, there is provided a fuel vapor processing device for an internal combustion engine. The fuel vapor processing device includes a canister, a purge control means, a temperature adjusting means and an activation control means. The canister includes a case and a fuel adsorption layer, which is received in the case and includes an adsorption material for adsorbing fuel vapor. One end of the case is communicated with a fuel vapor passage connected to a fuel tank and is also communicated with a purge passage connected to an intake passage of the internal combustion engine. The other end of the case is communicated with the atmosphere. The purge control means is for enabling temporary adsorption and retainment of fuel vapor, which is released from the fuel tank to the fuel vapor passage, in the fuel adsorption layer and for enabling desorption and conduction of the fuel vapor from the fuel adsorption layer into the intake passage through the purge passage during operation of the internal combustion engine. The temperature adjusting means is for adjusting the temperature of the fuel adsorption layer. The activation control means is for controlling activation and deactivation of the temperature adjusting means based on an adsorbed amount of fuel vapor adsorbed and retained in the fuel adsorption layer.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Embodiments of the present invention will be described with reference to the accompanying drawings.

(First Embodiment)

Figure 1:
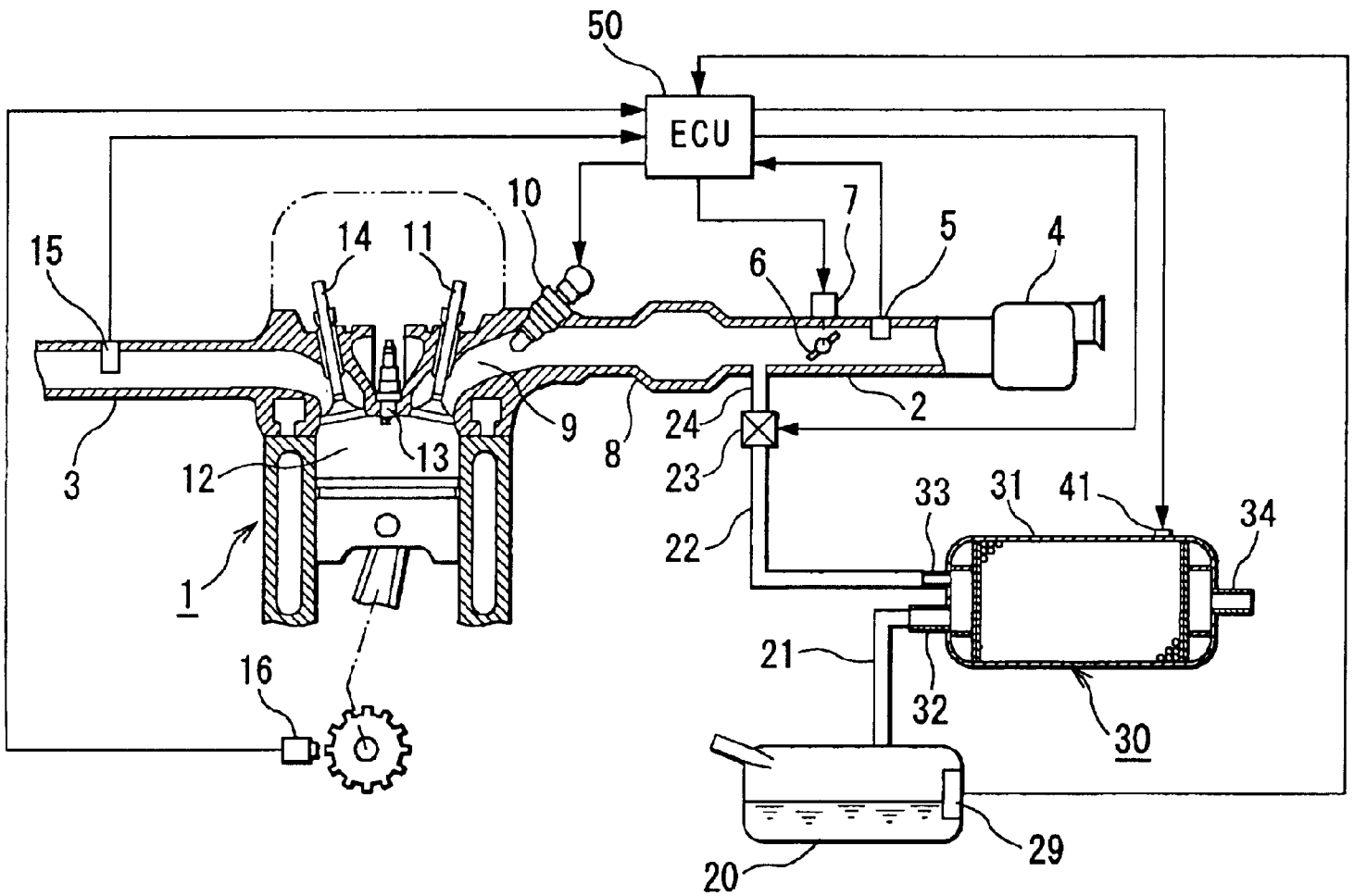
FIG. 1 is a schematic view of a fuel vapor processing device for an internal combustion engine according to a first embodiment of the present invention.

FIG. 1 is a schematic view showing the overall structure of a fuel vapor processing device of an internal combustion engine according to a first embodiment of the present invention.

In FIG. 1, an intake passage 2 and an exhaust passage 3 are connected to an internal combustion engine 1. An air cleaner 4 for filtering air is provided in an upstream region of the intake passage 2, and air is introduced into the intake passage 2 through the air cleaner 4. An airflow meter 5 is provided downstream of the air cleaner 4 to measure an amount of intake air introduced into the intake passage 2. A throttle valve 6 is provided downstream of the airflow meter 5 to adjust the amount of intake air for the internal combustion engine 1. The degree of opening (i.e., an operational position) of the throttle valve 6 is adjusted by an electric motor 7, which serves as an actuator driven based on, for example, an operational position of an accelerator pedal (not shown). Air, which has passed through the throttle valve 6 in the intake passage 2, is then supplied into a combustion chamber 12 of each cylinder of the internal combustion engine 1 through a surge tank 8 from an intake port 9 of the cylinder when an intake valve 11 of the cylinder is opened.

Also, liquid fuel (gasoline) is conducted from a fuel tank 20, in which the liquid fuel is stored, through a fuel supply line (not shown) and is injected from an injector (fuel injection valve) 10 into the intake port 9 of each cylinder of the internal combustion engine 1. This becomes a fuel-air mixture mixed with air and is supplied into the combustion chamber 12 of each cylinder when the intake valve 11 is opened. Also, a fuel gage 29 is provided in the fuel tank 20 for measuring the remaining fuel amount in the fuel tank 20.

The fuel tank 20 is connected to a tank orifice 32 of a cylindrical case 31 of a canister 30 through a fuel vapor passage 21. A fuel adsorption layer 35 filled with activated carbon C as an adsorption material is contained in the canister 30, as described below. Thus, fuel vapor vaporized in the fuel tank 20 is adsorbed and retained by the fuel adsorption layer 35 in the canister 30.

Then, the fuel vapor adsorbed and retained by the fuel adsorption layer 35 in the canister 30 is desorbed from the fuel adsorption layer 35 when a purge valve 23, which is operated based on an operational state of the internal combustion engine 1, is opened. The fuel vapor is then conducted from the canister 30 to the intake passage 2 through a purge passage 22, which is connected to a purge orifice 33 of the case 31 of the canister 30, the purge valve 23, and a purge passage 24, which is connected to the intake passage 2 on the upstream side of the surge tank 8. The purge passage 22 and the purge passage 24 cooperate together to serve as a purge passage of the present invention. A closure valve (not sown) is provided in the atmosphere communicating orifice 34 formed in the canister 30, such that the atmosphere communicating orifice 34 can be opened to the atmosphere through operation of the closure valve as needed. Also, a heater plate 40 described below is arranged in the canister 30. A connector 41 for supplying electric power to the heater plate 40 is provided in the canister 30.

The air-fuel mixture supplied into the combustion chamber 12 of each cylinder of the internal combustion engine 1 is ignited and combusted at a predetermined combustion timing by an ignition plug 13 provided at the top of the cylinder. Exhaust gases after the combustion are exhausted from the combustion chamber 12 into the exhaust passage 3 through an exhaust valve 14. An A/F (air fuel ratio) sensor 15 is provided in this exhaust passage 3 to measure the oxygen concentration in the exhaust gases. Numeral 16 depicts a crank angle sensor for detecting the revolutions per minutes (RPM) of the internal combustion engine 1.

Numeral 50 depicts an electronic control unit (ECU). The ECU 50 is structured as a logic computing circuit, which includes a central processing unit (CPU) that performs various known computing processes, a ROM that stores control programs etc., a RAM that stores various data, a back up (B/U) RAM, an input/output circuit, and bus lines connecting these.

To determine a current operational state of the internal combustion engine 1, the ECU 50 reads the amount of intake air from the air flow meter 5, the oxygen concentration from the A/F sensor 15, the engine RPM from the crank angle sensor 16, the remaining fuel amount from the fuel gauge 29, and other signals from various other sensors. Then, based on control signals computed and set in the ECU 50, electricity is supplied to the electric motor 7 for driving the throttle valve 6, the injector 10 for supplying liquid fuel by injection, the purge valve 23 for fuel vapor purge control, the connector 41 for the heater plate 40 built into the canister 30, etc.

Next, the detailed structure of the canister 30 will be described with reference to FIGS. 2–4.

Figure 2:
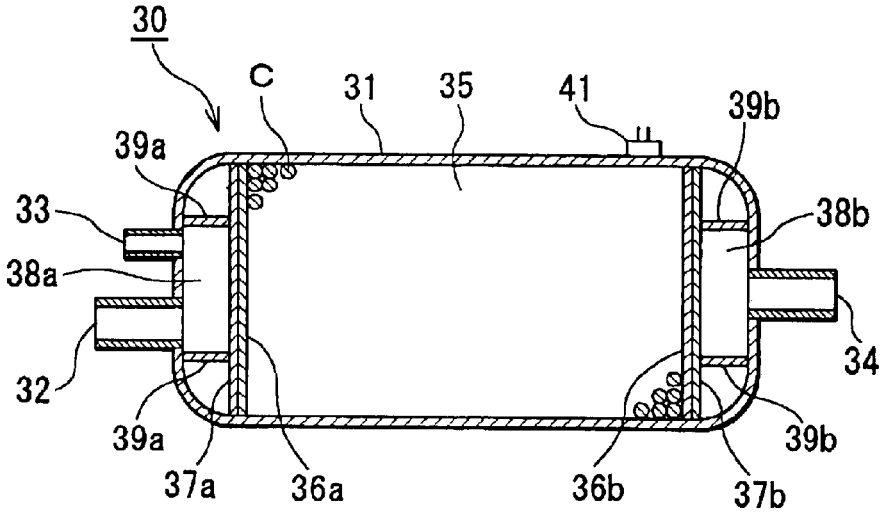
FIG. 2 is a schematic cross sectional view of a canister of the fuel vapor processing device shown in FIG. 1.
Figure 3:
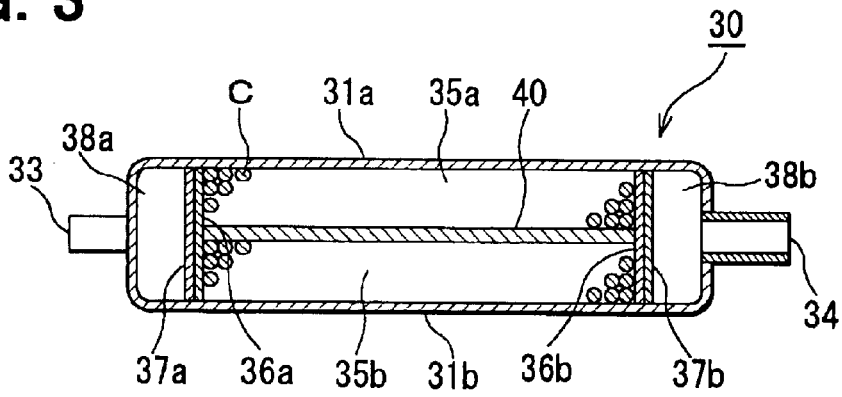
FIG. 3 is a central cross sectional view of the canister shown in FIG. 2.

With reference to FIGS. 2 and 3, as described above, the tank orifice 32 connected to the fuel tank 20, the purge orifice 33 connected to the intake passage 2 of the internal combustion engine 1, and the atmosphere communicating orifice 34 are formed in the cylindrical case 31, which forms the exterior wall of the canister 30. The fuel adsorption layer 35, which is filled with the activated carbon C as adsorption material, is arranged in the case 31. Porous plates 37*a*, 37*b* are provided respectively on opposed end surfaces of the fuel adsorption layer 35 such that a corresponding filter 36*a*, 36*b* is interposed between the fuel adsorption layer 35 and each porous plate 37*a*, 37*b*.

A space 38*a*, 38*b* is formed between each end surface of the case 31 and the opposed corresponding porous plate 37*a*, 37*b*. The spaces 38*a*, 38*b* allows uniform distribution of the fuel vapor or atmospheric air throughout the fuel adsorption layer 35. Also, the fuel adsorption layer 35 is clamped in place by the spring force of springs 39*a*, 39*b*, which are provided respectively in spaces 38*a*, 38*b* inside the case 31.

The fuel adsorption layer 35 in the canister 30 temporarily adsorbs and retains fuel vapor discharged from the fuel tank 20. As shown in FIG. 3, the fuel adsorption layer 35 is divided into two fuel adsorption layers 35*a*, 35*b* by the heater plate 40. Here, the heater plate 40 serves as a partition wall, which is parallel to a fuel vapor flow direction (left and right direction in FIG. 3) and is also parallel to wide side walls 31*a*, 31*b* of the case 31.

Figure 4:
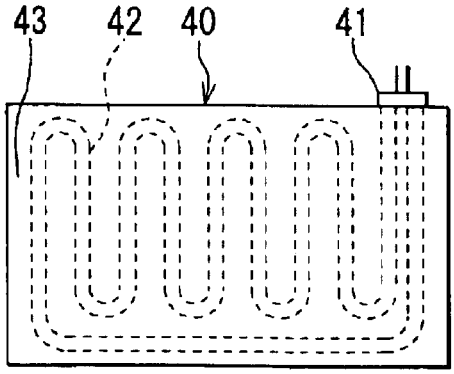
FIG. 4 is a schematic plan view of a heater plate arranged in the canister shown in FIG. 3.

Also, as shown in FIG. 4, nearly the entire interior of the heater plate 40 is filled with a heating wire heater 42, which serves as a heating element. The heating wire heater 42 is covered with an insulation material 43 to minimize loss of heat transfer efficiency. This arrangement prevents direct contact between the fuel adsorption layer 35 (35*a*, 35*b*) charged with the activated carbon C and the heating wire heater 42. A main body of the heater plate 40 is made of a metal with relatively high heat transfer efficiency, such as stainless steel. The connector 41, which is connected to the heating wire heater 42, is provided at an end of the heater plate 40. The connector 41 is also connected to a voltage controller (not shown). When the ECU 50 initiates supply of electricity to the heating wire heater 42 through the connector 41 of the heater plate 40 to heat the fuel adsorption layer 35 (35*a*, 35*b*) within the canister 30, desorption of fuel vapor adsorbed and retained by the activated carbon C is accelerated. This may of course be structured using a positive temperature coefficient (PTC) heater or other heating element in place of the heating wire heater 42.

Figure 5:
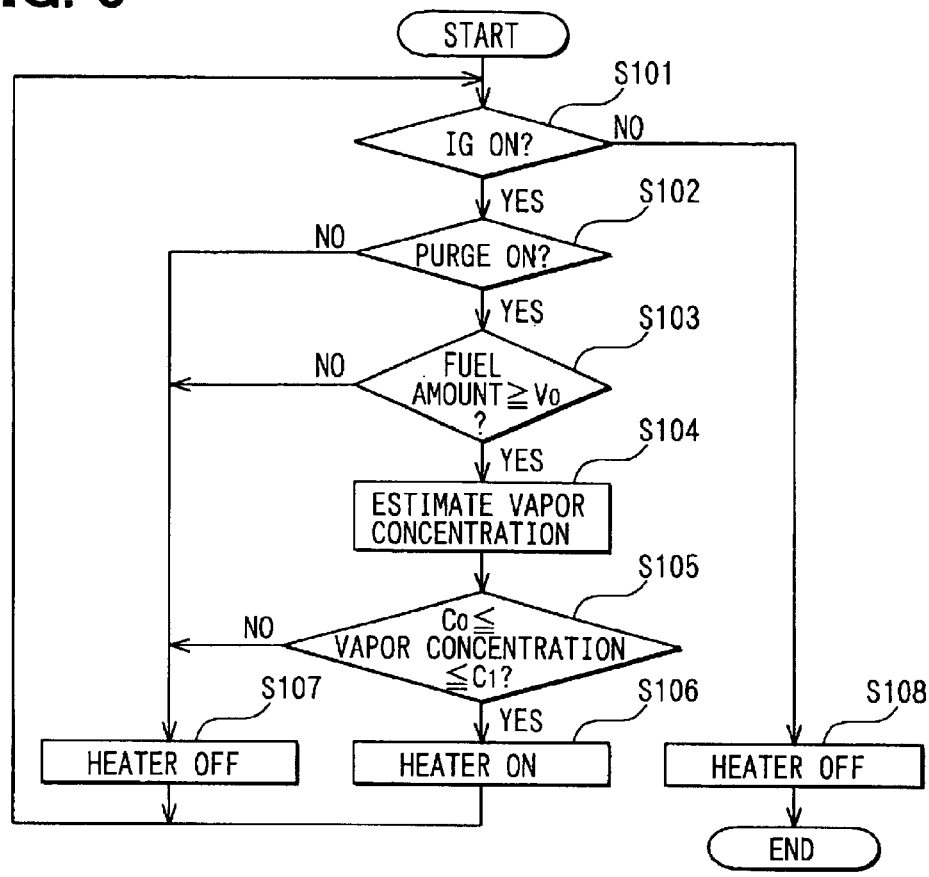
FIG. 5 is a flow chart showing a temperature adjustment control process performed in an ECU of the fuel vapor processing device according to the first embodiment.
Figure 6:
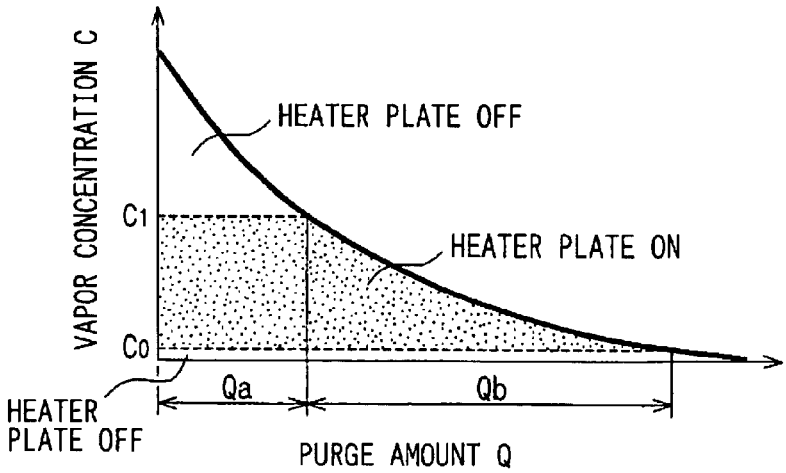
FIG. 6 is a map for setting ON/OFF of the heater plate using a purge amount and a purge fuel vapor concentration.

Next, an explanation referring to FIG. 6 is given based on the flowchart in FIG. 5, which shows the temperature adjustment control operation in the ECU 50 used in the fuel vapor processing device for the internal combustion engine according to the first embodiment of the present invention. FIG. 6 shows a map for setting ON/OFF of the heater plate 40 using a required purge amount Q and a purge fuel vapor concentration C of fuel vapor from the canister 30 as parameters. This routine of the temperature adjustment control operation is repeatedly performed by the ECU 50 at specified time intervals.

In FIG. 5, first, at step S101, it is determined whether an ignition (IG) is ON. When the answer to the inquiry at step S101 is YES, i.e., when an ignition switch (IGSW) for starting the internal combustion engine 1 is ON, and the internal combustion engine 1 is running, then control proceeds to step S102 where it is determined whether the purge is ON. When the answer to the inquiry at step S102 is YES, i.e., when it is determined that purge control can be performed, for example, based on the operational condition of the internal combustion engine 1, then control proceeds to step S103. At step S103, it is determined whether a remaining fuel amount in the tank 20 is equal to or greater than a predetermined amount V0.

When the answer to the inquiry at step S103 is YES, i.e., when the remaining fuel amount measured with the fuel gauge 29 is equal to or greater than the predetermined amount V0, then purge control must be performed, so that control moves to step S104. At step S104, a purge fuel vapor concentration, which is under purge control that is performed in connection with a known air-fuel ratio control operation carried out based on an output signal of A/F sensor 15, is estimated.

In general, the purge fuel vapor concentration of the fuel vapor desorbed from the canister 30 increases as the adsorbed fuel amount increases, and the purge fuel vapor concentration decreases as the adsorbed fuel amount decreases. Since high purge fuel vapor concentration disrupts the measurement of the air-fuel ratio beyond the purge control range of the air-fuel ratio control, the purge fuel vapor concentration should not exceed an allowable value that is determined based on the operational state of the internal combustion engine 1. Also, from a power saving perspective, it is not favorable to constantly conduct electricity to the heater plate 40 during purge control. Electricity should be conducted only when the desorption of the fuel from the canister 30 is required.

Therefore, as shown in FIG. 6, to promote desorption of the fuel vapor adsorbed and retained in the canister 30 while maintaining favorable air-fuel ratio control and power saving, electric current to the heater plate 40 should be controlled as follows. That is, the heater stops heating when the purge fuel vapor concentration is relatively high and when the adsorbed fuel amount is relatively large. In contrast, the heater should be turned on when the purge fuel vapor concentration is relatively low and when the adsorbed fuel amount is relatively small. Thus, the purge control can be performed by controlling supply of the electricity to the heater plate 40 based on the purge fuel vapor concentration, which is estimated in connection with the air-fuel ratio control, without using a purge fuel vapor concentration detecting sensor.

Next, control proceeds to step S105 where it is determined whether the estimated purge fuel vapor concentration calculated at step S104 is between the predetermined concentration C0 and the predetermined concentration C1. When the answer to the inquiry at step S105 is YES, i.e., when the purge fuel vapor concentration is between the predetermined concentration C0 (which is substantially zero) and the predetermined concentration C1 (at which electricity conduction control of the heater plate 40 becomes necessary), then control proceeds to step S106. At step S106, the heater is turned on, that is, the heater plate 40 is energized because forceful temperature adjustment control by heating with the heater is necessary to promote purging of the fuel vapor adsorbed and retained in the fuel adsorption layer 35 (35*a*, 35*b*) of the canister 30. After this, control returns to step S101 to repeat the same process.

Meanwhile, when the answer to the inquiry at step S102 is NO, i.e., when purge control cannot be performed due to, for example, the current operational condition of the internal combustion engine 1, control moves to step S107. Also, when the answer to the inquiry at step 103 is NO, i.e., when the remaining fuel amount measured with the fuel gauge 29 is less than the predetermined amount V0, and thus it is assumed that refueling will be performed soon, control moves to step S107. Furthermore, when the answer to the inquiry at step S105 is NO, i.e., when the purge fuel vapor concentration is less than the predetermined concentration C0, or when the purge fuel vapor concentration is sufficiently high, exceeding the predetermined concentration C1, then control proceeds to step S107. At step S107, the heater is turned OFF, that is, the heater plate 40 is deenergized because there is no need to promote purging of the fuel vapor adsorbed and retained in the fuel adsorption layer 35 (35*a*, 35*b*) inside the canister 30. Then, control returns to step S101 to repeat the same process. Meanwhile, when the answer to the inquiry at step S101 is NO, i.e., when the internal combustion engine 1 is stopped, then purge control cannot be performed, and control thus proceeds to step S108 where the heater is turned off, that is, the heater plate 40 is deenergized, and this routine ends.

Thus, the fuel vapor processing device for the internal combustion engine according to this embodiment includes the canister 30, a purge control means, a temperature adjusting means and an activation control means. The canister 30 includes the case 31 and the fuel adsorption layer 35 (35*a*, 35*b*) that is received in the case 31 and includes the activated carbon C, which serves as the adsorption material for adsorbing fuel vapor. One end of the case 31 is communicated with the fuel vapor passage 21 connected to the fuel tank 20 and is also communicated with the purge passages 22, 24 connected to the intake passage 2 of the internal combustion engine 1. The atmosphere communicating orifice 34 of the other end of the case 31 is communicated with the atmosphere. The purge control means is embodied by the purge valve 23 and the ECU 50 and is for enabling temporary adsorption and retainment of fuel vapor, which is released from the fuel tank 20 to the fuel vapor passage 21, in the fuel adsorption layer 35 (35*a*, 35*b*) and for enabling desorption and conduction of the fuel vapor from the fuel adsorption layer 35 (35*a*, 35*b*) into the intake passage 2 through the purge passages 22, 24 during operation of the internal combustion engine 1. The temperature adjusting means is embodied by the heater plate 40 and the ECU 50 and is for adjusting the temperature of the fuel adsorption layer 35 (35*a*, 35*b*). The activation control means is embodied by the ECU 50 and is for controlling activation and deactivation of the temperature adjusting means based on the purge fuel vapor concentration estimated in conjunction with air-fuel ratio control operation of the internal combustion engine 1.

In other words, when purging of the fuel vapor, which has been released from the fuel tank 20 and has bee adsorbed and retained within the fuel adsorption layer 35 (35*a*, 35*b*) in the canister 30, is controlled by controlling the purge valve 23, ON/OFF of the heater plate 40 is controlled based on the estimated purge fuel vapor concentration calculated in conjunction with the air-fuel ratio control operation of the internal combustion engine 1. This eliminates the need for a sensor for measuring the concentration of purge fuel vapor conducted from the canister 30 to the intake passage 2 of the internal combustion engine 1 through the purge passages 22, 24. This enables favorable fuel vapor processing with a simple structure.

Also, the activation control means, which is embodied by the ECU 50 of the fuel vapor processing device of the internal combustion engine in this embodiment, deactivates the temperature adjusting means, which is embodied by the heater plate 40 and the ECU 50, when the purge fuel vapor concentration is higher than the predetermined value C1 or when the purge fuel vapor concentration is nearly zero. The control means activates the temperature adjusting means when the purge fuel vapor concentration is less than the predetermined value C1.

In other words, when the purge fuel vapor concentration is higher than the predetermined value C1, the fuel vapor adsorbed and retained in the fuel adsorption layer 35 (35*a*, 35*b*) inside the canister 30 is easily desorbed, and thus energization of the heater plate 40 is not necessary. Also, when the purge fuel vapor concentration is less than the predetermined value C0 and is substantially zero, there is substantially no fuel vapor adsorbed and retained in the fuel adsorption layer 35 (35*a*, 35*b*) inside the canister 30, and thus the energization of the heater plate 40 is not required to save energy. In any other case, i.e., when the purge fuel vapor concentration is less than the predetermined value C1, the fuel vapor adsorbed and retained in the fuel adsorption layer 35 (35*a*, 35*b*) inside the canister 30 is difficult to desorb. Thus, in such a case, purging of the fuel is promoted by energizing the heater plate 40. In this way, the fuel vapor processing can be executed at the appropriate timing.

Next, a modification of the temperature adjustment control operation performed by the ECU 50 of the fuel vapor processing device of the internal combustion engine according to the first embodiment of present invention will be described with reference to the flowcharts in FIGS. 7 and 8. This temperature adjustment control routine is performed repeatedly by the ECU 50 at predetermined time intervals.

Figure 7:
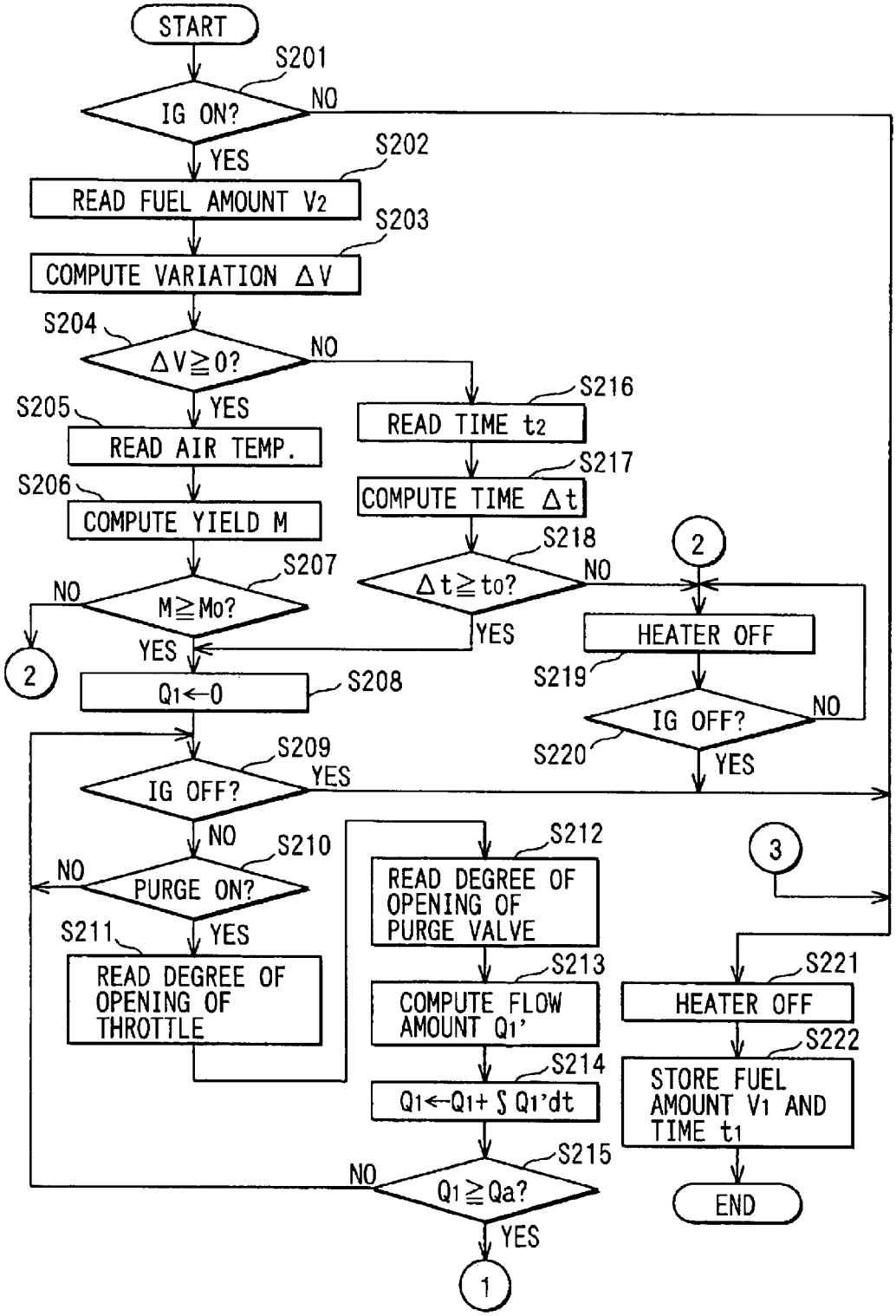
FIG. 7 is a flow chart showing a first part of a modification of the temperature adjustment control process of the first embodiment.

In FIG. 7, first, at step S201, it is determined whether the IG is ON. When the answer to the inquiry at step S201 is YES, i.e., when the internal combustion engine 1 is running, then control proceeds to step S202. At step S202, the remaining fuel amount V2 is read from the fuel gauge 29. Next, control proceeds to step S203, the fuel amount variation ΔV per unit time is calculated based on the current remaining fuel amount V2, which is read at step S202, and the previous remaining fuel amount.

Next, control proceeds to step S204 where it is determined whether the fuel amount variation ΔV calculated at step S203 is equal to or greater than 0 (zero). When the answer to the inquiry at step S204 is YES, i.e., when the fuel amount variation ΔV is equal to or greater than zero on a positive side, it is assumed that that the fuel amount was increased by refueling, and control proceeds to step S205. At step S205, the intake air temperature is read from the intake air temperature sensor (not shown). Then, control proceeds to step S206 where an estimated fuel vapor yield M is calculated from the fuel amount variation ΔV and the intake air temperature. Next, control proceeds to step S207 where it is determined whether the estimated fuel vapor yield M is equal to or greater than a predetermined amount M0. When the answer to the inquiry at step S207 is YES, i.e., when the estimated fuel vapor yield M calculated at step S206 is equal to or greater than the predetermined amount M0, then it is assumed that purging of the fuel is necessary, and control proceeds to step S208. At step S208, a purge amount Q1 is set to an initial value of zero.

Next, control proceeds to step S209 where it is determined whether the IG is OFF. When the answer to the inquiry at step S209 is NO, i.e., when the internal combustion engine 1 is running, control proceeds to step S210. At step S210, it is determined whether the purge is ON. When the answer to the inquiry at step S210 is YES, i.e., when the operational condition of the internal combustion engine 1 or the like makes purge control possible, then control proceeds to step S211. At step S211, the degree of opening (i.e., an operational position) of the throttle valve 6 is read. Then, control proceeds to step S212 where the degree of opening (i.e., an operational position) of the purge valve 23 is read.

Next, control proceeds to step S213 where the purge flow amount Q1' of the fuel vapor, which flows through the purge passage 24, is calculated based on a negative pressure in the intake passage 2, which corresponds to the degree of opening of the throttle valve 6 read at step S211, and also based on the degree of opening of the purge valve 23 read at step S212. Next, control proceeds to step S214 where an integral value of the current purge flow amount Q1' calculated at step S213 is added to the previous purge amount Q1 to update the purge amount Q1. Next, control proceeds to step S215 where it is determined whether the purge amount Q1 updated at step S214 is equal to or greater than a predetermined purge amount Qa. Here, the predetermined purge amount Qa is the purge amount necessary for the purge fuel vapor concentration in FIG. 6 to decrease from the maximum concentration to C1. When the answer to the inquiry at the step S215 is NO, i.e., when the purge amount Q1 is less than the predetermined purge amount Qa, and thus it is assumed that not very much fuel vapor has been purged from the fuel adsorption layer 35 (35*a*, 35*b*) inside the canister 30, control returns to step S209 to repeat the same process. Also, when the answer to the inquiry at step S210 is NO, i.e., when the purge control cannot be performed due to, for example, the operational condition of the internal combustion engine 1, the control returns to step S209. Meanwhile, when the answer to the inquiry at step S215 is YES, i.e., when the purge amount Q1 is equal to or greater than the predetermined purge amount Qa, i.e., when the fuel vapor adsorbed and retained in the fuel adsorption layer 35 (35*a*, 35*b*) inside the canister 30 has been purged to a certain extent, and thus it is assumed that the purge fuel vapor concentration has decreased to a level equal to or less than C1, then control proceeds to step S223 in FIG. 8, as described below.

When the answer to the inquiry at step S204 is NO, i.e., when the fuel amount variation ΔV is less than zero on a negative side, it is assumed that there is no adsorbed fuel amount increase caused by refueling, and thus control proceeds to step S216. At the same time, the current time t2 is read. Next, control proceeds to step S217 where a non-operating time period Δt of the internal combustion engine 1 is calculated based on the previous stopping time of the internal combustion engine 1 and the current stopping time t2 of the internal combustion engine 1 read at step S216. Next, control proceeds to step S218 where it is determined whether the non-operating time period Δt is equal to or greater than a predetermined non-operating time period t0. When the answer to the inquiry at step S218 is YES, i.e., when the non-operating time period Δt calculated at step S217 is equal to or greater than the predetermined non-operating time period t0, it is assumed that that the adsorbed fuel amount has increased during the non-operating time period, and thus control proceeds to step S208 described above, repeating the operation described above.

When the answer to the inquiry at step S218 is NO, i.e., when the non-operating time period Δt calculated at step S217 is less than the predetermined non-operating time period t0, it is assumed that that the adsorbed fuel amount has almost no increase during the non-operating time period, and control moves to step S219. Also, when the answer to the inquiry at step S207 is NO, i.e., when the estimated fuel vapor yield M is less than the predetermined amount M0, it is assumed that the adsorbed fuel amount has almost no increase, and thus control moves to step S219. At step S219, the heater is turned OFF, that is, the heater plate 40 is deenergized. Then, control moves to step S220 where it is determined whether the IG is OFF. If the answer to the inquiry at step S220 is NO, i.e., when the internal combustion engine 1 is running, control returns to step S219 to repeat the same process. When the answer to the inquiry at step S201 is NO, control moves to step S221. Also, when the answer to the inquiry at step 209 or step 220 is YES, i.e., when the internal combustion engine 1 is stopped, the purge control cannot be performed, so that control proceeds to step S221. At step S221, the heater is turned OFF, that is, the heater plate 40 is deenergized. Then, control proceeds to step S222 where the current remaining fuel amount V1 and the current time t1 are stored in the memory, and the present routine ends.

Figure 8:
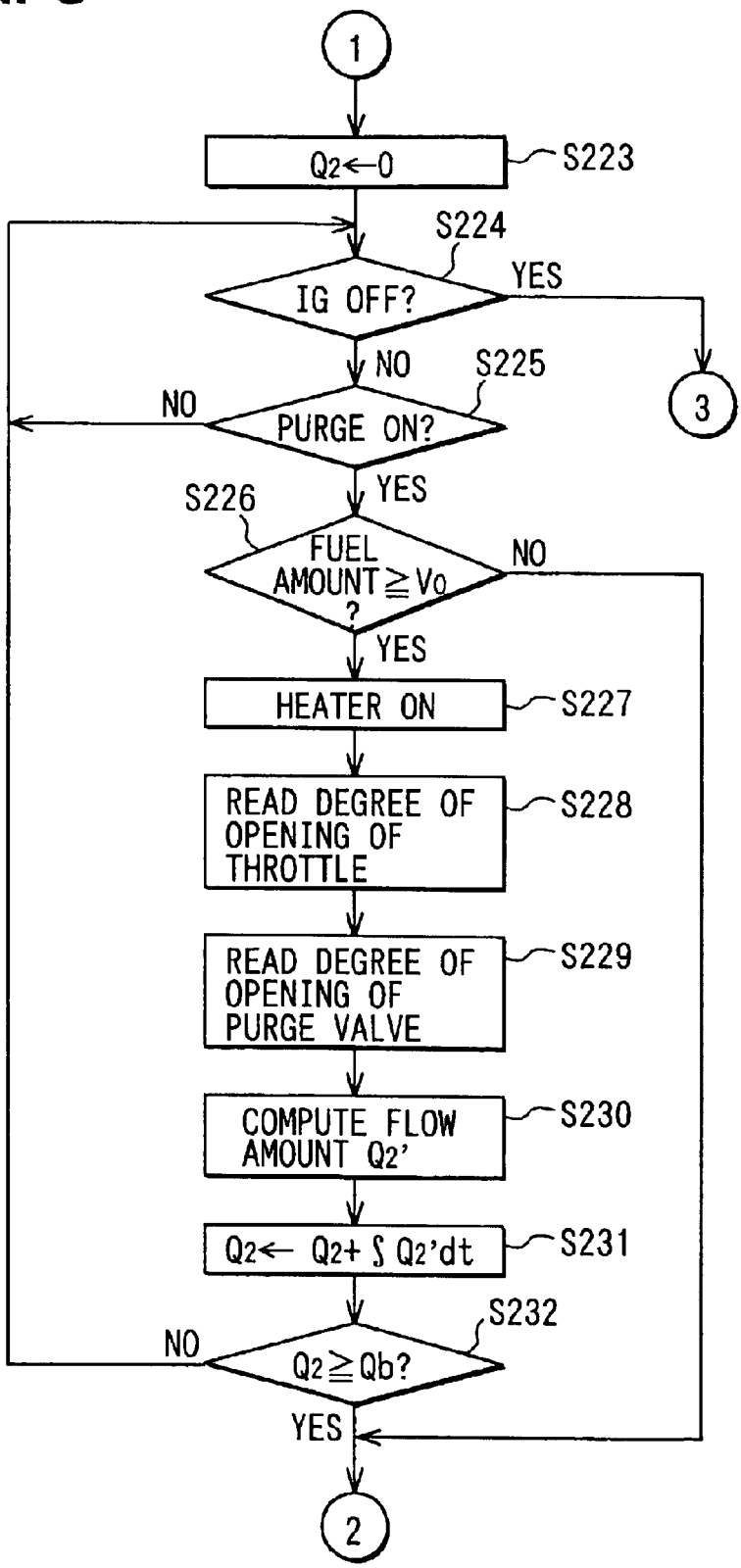
FIG. 8 is a flow chart showing a second part of the modification of the temperature adjustment control process.

Next, when the answer to the inquiry at step S215 in FIG. 7 is YES, i.e., when the purge amount Q1 is equal to or greater than the predetermined purge amount Qa, and thus it is assumed that the fuel vapor in the fuel adsorption layer 35 has been some what purged to make the purge fuel vapor concentration equal to or less than C1, control proceeds to step S223 in FIG. 8. At step S223, first, the purge amount Q2 is reset to 0 (zero). Next, control proceeds to step S224 where it is determined whether the IG is OFF. When the answer to the inquiry at step S224 is NO, i.e., when the internal combustion engine 1 is running, control proceeds to step S225 where it is determined whether the purge is ON. When the answer to the inquiry at step S225 is YES, i.e., when the purge control can be performed due to the current operational condition of the internal combustion engine 1, control proceeds to step S226. At step S226, it is determined whether the remaining fuel amount measured with the fuel gauge 29 is equal to or greater than the predetermined amount V0. When the answer to the inquiry at step S226 is YES, i.e., when the remaining fuel amount is equal to or greater than the predetermined amount V0, control proceeds to step S227. At step S227, the heater is turned ON, that is, the heater plate 40 is energized. Next, control proceeds to step S228 where the degree of opening of the throttle valve 6 is read. Then, control proceeds to step S229 where the degree of opening of the purge valve 23 is read.

Next, control proceeds to step S230 where the purge flow amount Q2' of the purged fuel vapor flowing through purge passage 24 is calculated based on a negative pressure in the intake passage 2, which corresponds to the degree of opening of the throttle valve 6 read at step S228, and also based on the degree of the opening of the purge valve 23 read at step S229. Then, control moves to step S231 where an integral value of the current purge flow amount Q2' calculated at step S230 is added to the previous purge amount Q2 to update the purge amount Q2. Next, control moves to step S232 where it is determined whether the purge amount Q2 updated at step S231 is equal to or greater than a predetermined purge amount Qb. Here, the predetermined purge amount Qb is the purge amount required to decrease the purge fuel vapor concentration from C1 to C0 in FIG. 6. When the answer to the inquiry at step S232 is NO, i.e., when the purge amount Q2 is less than the predetermined purge amount Qb, and thus it is assumed that fuel vapor still remains in the fuel adsorption layer 35 (35*a*, 35*b*) inside the canister 30, control returns to step S224. Also, when the answer to the inquiry at step S225 is NO, i.e., when purge control cannot be performed due to, for example, the operational condition of the internal combustion engine 1, control returns to step S224 to repeat the same process.

However, when the answer to the inquiry at step S232 is YES, i.e., when the purge amount Q2 is equal to or greater than the predetermined purge amount Qb, and thus it is assumed that the fuel vapor adsorbed and retained in the fuel adsorption layer 35 (35*a*, 35*b*) inside the canister 30 is sufficiently purged, control returns to step S219 in FIG. 7 to repeat the same process. Meanwhile, when the answer to the inquiry at step S224 is YES, i.e., when the internal combustion engine 1 is stopped, the purge control cannot be performed, so that control returns to step S221 in FIG. 7 to repeat the same process.

As described above, the fuel vapor processing device for the internal combustion engine in this modification includes the canister 30, the purge control means, the temperature adjusting means and the activation control means. The canister 30 includes the case 31 and the fuel adsorption layer 35 (35*a*, 35*b*) that is received in the case 31 and includes the activated carbon C, which serves as the adsorption material for adsorbing fuel vapor. One end of the case 31 is communicated with the fuel vapor passage 21 connected to the fuel tank 20 and is also communicated with the purge passages 22, 24 connected to the intake passage 2 of the internal combustion engine 1. The atmosphere communicating orifice 34 of the other end of the case 31 is communicated with the atmosphere. The purge control means is embodied by the purge valve 23 and the ECU 50 and is for enabling temporary adsorption and retainment of fuel vapor, which is released from the fuel tank 20 to the fuel vapor passage 21, in the fuel adsorption layer 35 (35*a*, 35*b*) and for enabling desorption and conduction of the fuel vapor from the fuel adsorption layer 35 (35*a*, 35*b*) into the intake passage 2 through the purge passages 22, 24 during operation of the internal combustion engine 1. The temperature adjusting means is embodied by the heater plate 40 and the ECU 50 and is for adjusting the temperature of the fuel adsorption layer 35 (35*a*, 35*b*). The activation control means is embodied by the ECU 50 and is for controlling activation and deactivation of the temperature adjusting means based on the estimated fuel vapor yield (estimated canister adsorbed fuel amount, i.e., the adsorbed amount of fuel vapor) M of fuel vapor adsorbed and retained in the fuel adsorption layer 35 (35*a*, 35*b*).

In other words, when purging of the fuel vapor, which has been released from the fuel tank 20 and has bee adsorbed and retained within the fuel adsorption layer 35 (35*a*, 35*b*) in the canister 30, is controlled by controlling the purge valve 23, ON/OFF of the heater plate 40 is controlled based on the estimated fuel vapor yield (estimated canister adsorbed fuel amount) M adsorbed and retained in the fuel adsorption layer 35 (35*a*, 35*b*). This eliminates the need for a sensor for measuring the concentration of purge fuel vapor conducted from the canister 30 to the intake passage 2 of the internal combustion engine 1 through the purge passages 22, 24. This enables favorable fuel vapor processing with the simple structure.

Also, the activation control means, which is embodied by the ECU 50 of the fuel vapor processing device for the internal combustion engine in the this modification, calculates the estimated canister adsorbed fuel amount M based on the fuel amount variation ΔV, which represents the refueling amount of fuel refueled in the fuel tank 20. The activation control means calculates the purge amount Q required to purge the estimated canister adsorbed fuel amount M and controls the activation and deactivation of the temperature adjusting means, which is embodied by the heater plate 40 and the ECU 50.

That is, when the fuel amount variation ΔV, which is a difference between the previous remaining fuel amount V1 and the current remaining fuel amount V2 measured with the fuel gauge 29, has increased, it is assumed that refueling of the fuel tank 20 has been performed, and the estimated canister adsorbed fuel amount M, which is the amount of fuel adsorbed by the canister 30, is calculated. Electricity is conducted to the heater plate 40 to promote purging based on the required purge amount Q required to purge this estimated canister adsorbed fuel amount M. This favorably desorbs the fuel vapor adsorbed and retained in the fuel adsorption layer 35 (35*a*, 35*b*) inside the canister 30. This enables fuel vapor processing at the appropriate timing.

Also, the activation control means, which is embodied by the ECU 50 of the fuel vapor processing device for the internal combustion engine in this modification, calculates the estimated canister adsorbed fuel amount M based on the non-operating time period Δt of the internal combustion engine 1 and also calculates the required purge amount Q required to purge the estimated canister adsorbed fuel amount M. Then, the activation control means controls activation and deactivation of the temperature adjusting means, which is embodied by the heater plate 40 and the ECU 50.

That is, the non-operating time period Δt between the stopping time t1 of the internal combustion engine 1 and starting time t2 of the internal combustion engine 1 is used to calculate the estimated canister adsorbed fuel amount M, which is the amount of fuel vapor released from the fuel tank 20 and is thereafter adsorbed and retained in the fuel adsorption layer 35 (35*a*, 35*b*) of the canister 30. Electricity is conducted to the heater plate 40 to promote purging based on the required purge amount Q required to purge the estimated canister adsorbed fuel amount M. This favorably desorbs the fuel vapor adsorbed and retained in the fuel adsorption layer 35 (35*a*, 35*b*) of the canister 30. This allows fuel vapor processing to be performed with appropriate timing.

(Second Embodiment)

Figure 9:
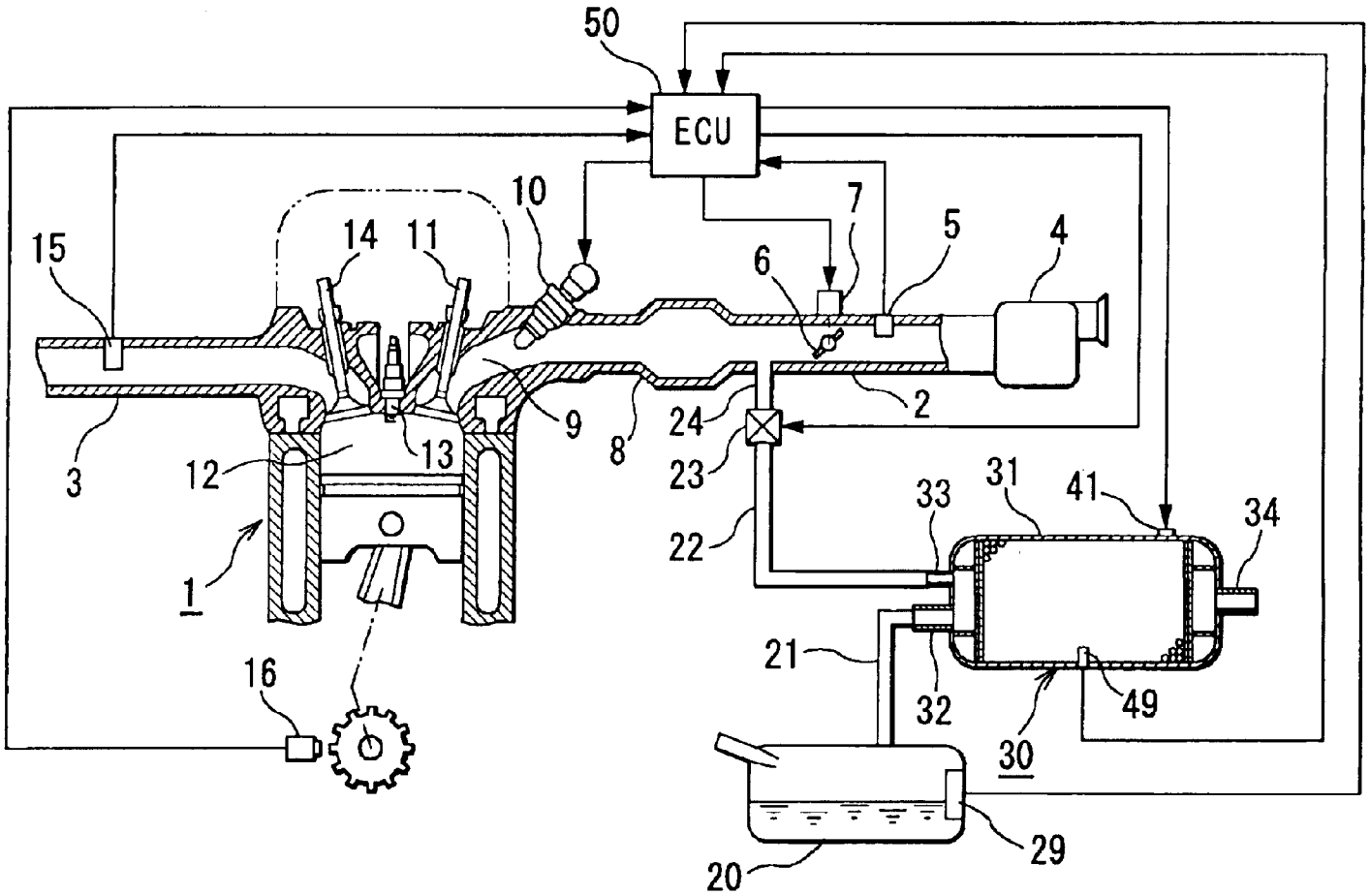
FIG. 9 is a schematic view of a fuel vapor processing device according to a second embodiment of the present invention.

FIG. 9 is a schematic view showing a fuel vapor processing device for an internal combustion engine according to a second embodiment of the present invention. In this embodiment, the only addition to the structure of the first embodiment is a temperature sensor 49 for measuring the temperature inside the canister 30. The components similar to those discussed with reference to the first embodiment will be indicated by the same numerals and will not be discussed further for the sake of simplicity.

Next, a procedure of the temperature adjustment control operation carried out in the ECU 50 of the fuel vapor processing device for an internal combustion engine according to the second embodiment of present invention will be described based on flowcharts shown in FIGS. 10–12. The temperature adjustment control routine is performed repeatedly by the ECU 50 at predetermined time intervals.

Figure 10:
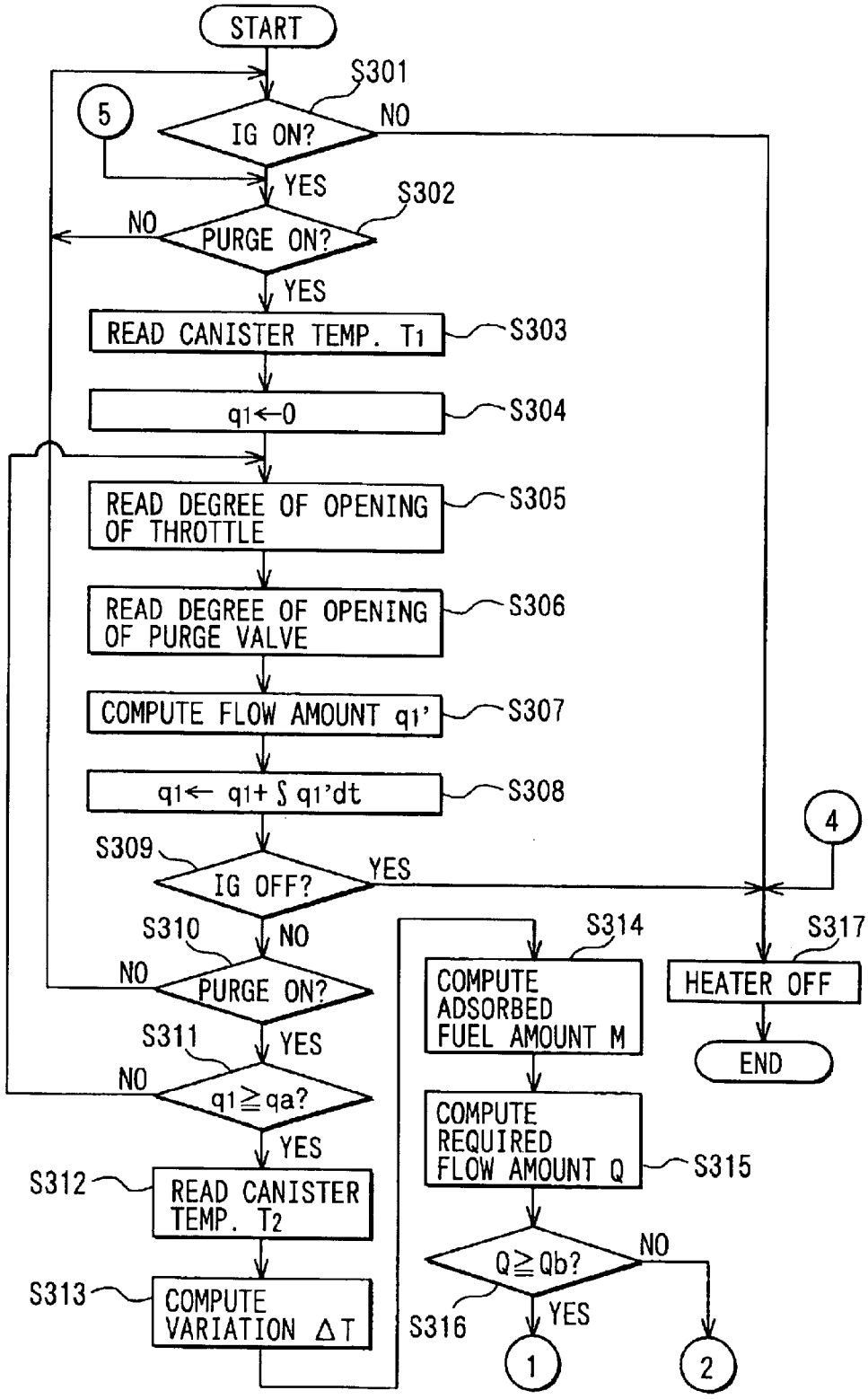
FIG. 10 is a flowchart showing a first part of a temperature adjustment control process performed in an ECU of the fuel vapor processing device according to the second embodiment.

First, in FIG. 10, at step S301, it is determined whether the IG is ON. When the answer to the inquiry at step S301 is YES, i.e., when the internal combustion engine 1 is running, control proceeds to step S302 where it is determined whether the purge is ON. When the answer to the inquiry at step S302 is YES, i.e., when it is determined that purge control can be performed, for example, based on the operational condition of the internal combustion engine 1, then control proceeds to step S303. At step S303, the canister temperature T1 is read from the temperature sensor 49 arranged in the canister 30. Then, control proceeds to step S304 where the purge amount q1 is reset to zero.

Next, control proceeds to step S305 where the degree of opening of the throttle valve 6 is read. Then, control proceeds to step S306 where the degree of opening of the purge valve 23 is read.

Next, control proceeds to step S307 where the purge flow amount q1' of the fuel vapor, which flows through the purge passage 24, is calculated based on a negative pressure in the intake passage 2, which corresponds to the degree of opening of the throttle valve 6 read at step S305, and also based on the degree of opening of the purge valve 23 read at step S306. Next, control proceeds to step S308 where an integral value of the current purge flow amount q1' calculated at step S307 is added to the previous purge amount q1 to update the purge amount q1. Next, control proceeds to step S309 where it is determined whether the IG is OFF. When the answer to the inquiry at step S309 is NO, i.e., when the internal combustion engine 1 is running, control proceeds to step S310. At step S310, it is determined whether the purge is ON. When the answer to the inquiry at step S310 is YES, i.e., when it is determined that purge control can be performed, for example, based on the operational condition of the internal combustion engine 1, then control proceeds to step S311. At step S311, it is determined whether the purge amount q1 renewed at step S308 is equal to or greater than a predetermined purge amount qa. The predetermined purge amount qa is the purge amount sufficient to cause a substantial change in the temperature in the canister 30.

When the answer to the inquiry at step S311 is YES, i.e., when it is assumed that the purge amount q1 equal to or greater than the predetermined purge amount qa is conducted, so that a certain amount of the fuel vapor adsorbed in the fuel adsorption layer 35 (35*a*, 35*b*) of the canister 30 is desorbed (i.e., when it is assumed that a substantial change in the temperature in the canister 30 has occurred due to the desorption of the fuel vapor), control proceeds to step S312. At step S312, the canister temperature T2 is read from the temperature sensor 49 arranged in the canister 30. Then, control proceeds to step S313 where a temperature variation ΔT is calculated based on the canister temperature T1 read at step S303 and the canister temperature T2 read at step S312. Then, control proceeds to step S314 where the estimated canister adsorbed fuel amount M, which is the amount of the fuel adsorbed and retained in the fuel adsorption layer 35 (35*a*, 35*b*) of the canister 30, is calculated based on the temperature variation ΔT. Next, control proceeds to step S315 where the required purge amount Q, which is required to purge the estimated canister adsorbed fuel amount M, is calculated.

Then, control proceeds to step S316 where it is determined whether the required purge amount Q is equal to or greater than a predetermined purge amount Qb. Here, the predetermined purge amount Qb is the purge amount required to decrease the purge fuel vapor concentration from C1 to C0 in FIG. 6. When the answer to the inquiry at step S316 is YES, i.e., when it is assumed that the required purge amount Q, which is calculated at step S315, is equal to or greater than the predetermined purge amount Qb, and thus it is assumed that the purge fuel vapor concentration is equal to or greater than C1, control proceeds to step S318 of FIG. 11. On the other hand, when the answer to the inquiry at step S316 is NO, i.e., when it is assumed that the required purge amount Q, which is calculated at step S315, is less than the predetermined purge amount Qb, and thus it is assumed that the purge fuel vapor concentration is equal to or less than C1, control proceeds to step S326 of FIG. 11, which will be described later.

Meanwhile, when the answer to the inquiry at step S301 is NO, control proceeds to step S317. Also, when the answer to the inquiry at step 309 is YES, i.e., when the internal combustion engine 1 is stopped, and thus the purge control cannot be performed, control proceeds to step S317. At step S317, the heater is turned OFF, i.e., the heater plate 40 is deenergized, and the current routine ends. On the other hand, when the answer to the inquiry at step S302 or step S310 is NO, and thus the purge control cannot be performed, control returns to step S301 to repeat the corresponding operation.

Meanwhile, when the answer to the inquiry at step S311 is NO, i.e., when the purge amount q1, which is renewed at step S308, is less than the predetermined purge amount qa, and thus the purge has not caused a substantial change in the temperature in the canister 30, control returns to step S305 to repeat the corresponding operation.

Figure 11:
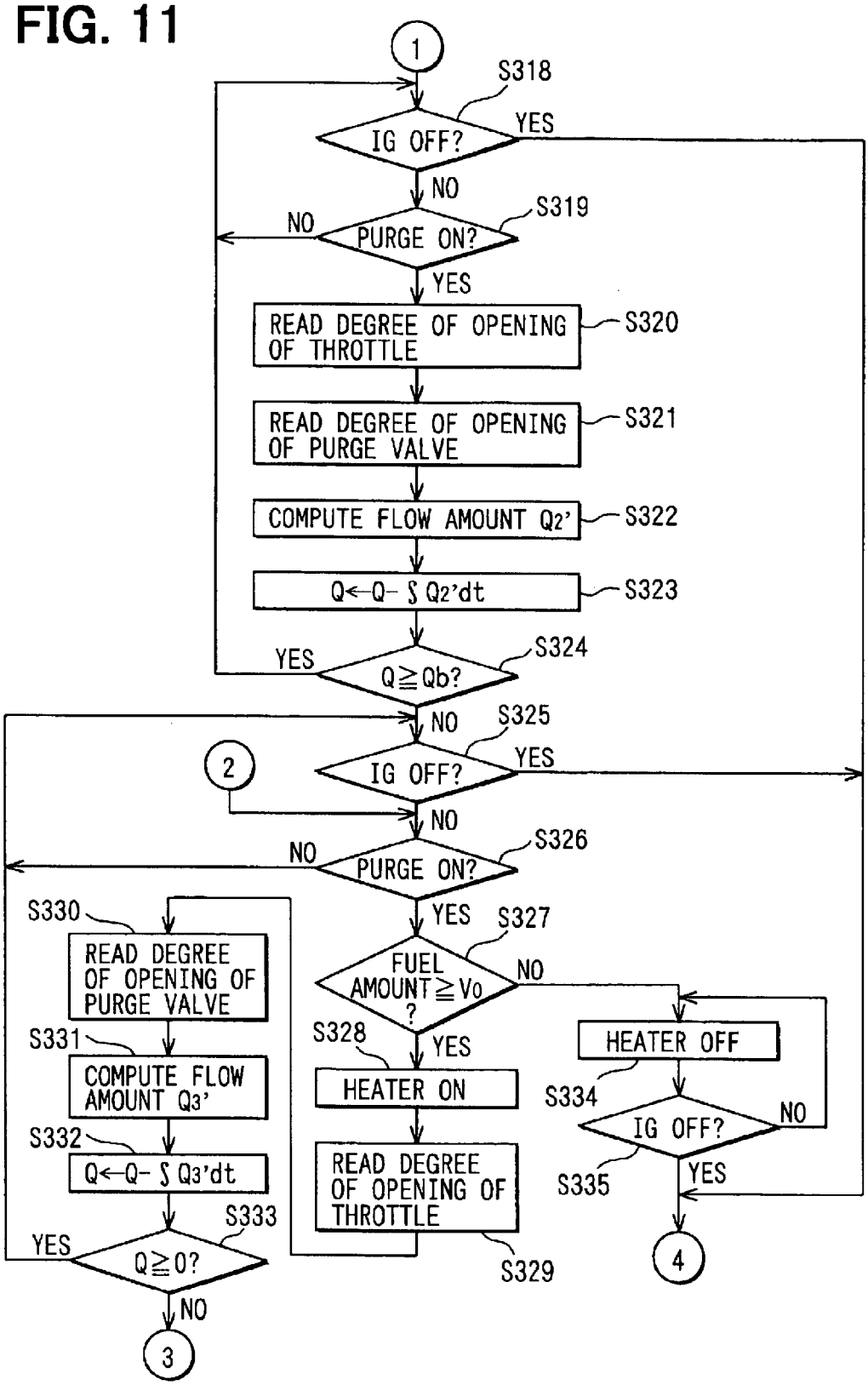
FIG. 11 is a flow chart showing a second part of the temperature adjustment control process according to the second embodiment.

Then, when the answer to the inquiry at step S316 in FIG. 10 is YES, i.e., when the required purge amount Q is equal to or greater than the predetermined purge amount Qb, and thus it is assumed that the purge fuel vapor concentration is equal to or greater than C1, control proceeds to step S318 in FIG. 11. At step S318, it is determined whether the IG is OFF. When the answer to the inquiry at step S318 is NO, i.e., when the internal combustion engine 1 is running, control proceeds to step S319. At step S319, it is determined whether the purge is ON. When the answer to the inquiry at step S319 is YES, i.e., when it is determined that purge control can be performed, for example, based on the operational condition of the internal combustion engine 1, then control proceeds to step S320. At step S320, the degree of opening of the throttle valve 6 is read. Then, control proceeds to step S321 where the degree of opening of the purge valve 23 is read.

Thereafter, control proceeds to step S322 where the purge flow amount Q2' of the fuel vapor, which flows through the purge passage 24, is calculated based on a negative pressure in the intake passage 2, which corresponds to the degree of opening of the throttle valve 6 read at step S320, and also based on the degree of opening of the purge valve 23 read at step S321. Next, control proceeds to step S323 where an integral value of the current purge flow amount Q2' calculated at step S322 is subtracted from the previous required purge amount Q to update the required purge amount Q. Next, control proceeds to step S324 where it is determined whether the required purge amount Q updated at step S323 is equal to or greater than a predetermined purge amount Qb. When the answer to the inquiry at step S324 is YES, i.e., when the required purge amount Q is equal to or greater than the predetermined purge amount Qb, and thus the sufficient amount of the fuel vapor remains in the fuel adsorption layer 35 (35*a*, 35*b*) of the canister 30, it is assumed that the purge fuel vapor concentration is equal to or greater than C1, and control proceeds to step S318 to repeat the corresponding operation. Also, when the answer to the inquiry at step 319 is NO, i.e., when the purge control cannot be performed due to, for example, the operational condition of the internal combustion engine 1, control returns to step S318 to repeat the corresponding operation.

On the other hand, when the answer to the inquiry at step S324 is NO, i.e., when the required purge amount Q is less than the predetermined purge amount Qb, and a certain amount of the fuel vapor is purged into the adsorption layer 35 (35*a*, 35*b*) of the canister 30, and thus it is assumed that the purge fuel vapor concentration is reduced to become equal to or less than C1, control proceeds to step S325. At step S325, it is determined whether the IG is OFF. When the answer to the inquiry at step S325 is NO, i.e., when the internal combustion engine 1 is running, control proceeds to step S326. At step S326, it is determined whether the purge is ON. When the answer to the inquiry at step S326 is YES, i.e., when it is determined that purge control can be performed, for example, based on the operational condition of the internal combustion engine 1, control proceeds to step S327. At step S327, it is determined whether the remaining fuel amount measured with the fuel gauge 29 is equal to or greater than the predetermined amount V0. When the answer to the inquiry at step S327 is YES, i.e., when the remaining fuel amount is equal to or greater than the predetermined amount V0, control proceeds to step S328. At step S328, the heater is turned ON, i.e., the heater plate 40 is energized. Next, control proceeds to step S329 where the degree of opening of the throttle valve 6 is read. Then, control proceeds to step S330 where the degree of opening of the purge valve 23 is read.

Next, control proceeds to step S331 where the purge flow amount Q3' of the fuel vapor, which flows through the purge passage 24, is calculated based on a negative pressure in the intake passage 2, which corresponds to the degree of opening of the throttle valve 6 read at step S329, and also based on the degree of opening of the purge valve 23 read at step S330. Next, control proceeds to step S332 where an integral value of the current purge flow amount Q3' calculated at step S331 is subtracted from the previous required purge amount Q to update the required purge amount Q. Next, control proceeds to step S333 where it is determined whether the required purge amount Q updated at step S332 is equal to or greater than 0 (zero). When the answer to the inquiry at step S333 is YES, i.e., when the required purge amount Q is equal to or greater than zero, and thus it is assumed that the fuel vapor remains in the fuel adsorption layer 35 (35*a*, 35*b*) of the canister 30, control returns to step S325. Also, when the answer to the inquiry at step S326 is NO, i.e., when the purge control cannot be performed due to, for example, the operational condition of the internal combustion engine 1, control returns to step S325 to repeat the corresponding operation. On the other hand, when the answer to the inquiry at step S333 is NO, i.e., when the required purge amount Q is less than zero, and thus it is assumed that the fuel vapor does not remain in the fuel adsorption layer 35 (35*a*, 35*b*) of the canister 30, control proceeds to step S336 in FIG. 12.

On the other hand, when the answer to the inquiry at step S327 is NO, i.e., when the remaining fuel amount is less than the predetermined amount V0, and thus it is assumed that refueling will be performed soon, control moves to step S334. At step S334, the heater is turned OFF, i.e., the heater plate 40 is deenergized. Next, control proceeds to step S335 where it is determined whether the IG is OFF. When the answer to the inquiry at step S335 is NO, i.e., when the internal combustion engine is running, control returns to step S334 to repeat the corresponding operation. On the other hand, when the answer to the inquiry at any one of steps S318, S325 and S335 is YES, i.e., when the internal combustion engine is stopped, and thus the purge control cannot be performed, control returns to step S317 in FIG. 10 and repeats the corresponding operation. Meanwhile, when the answer to the inquiry at step S316 in FIG. 10 is NO, and the required purge amount Q is less than the predetermined purge amount Qb, control proceeds to step S326 in FIG. 11 to perform the operation.

Figure 12:
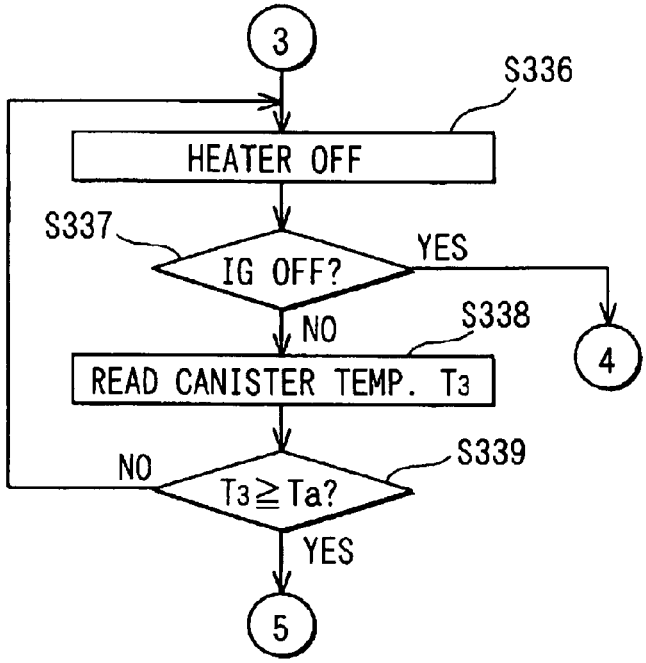
FIG. 12 is a flow chart showing a third part of the temperature adjustment control process according to the second embodiment.

Then, when the answer to the inquiry at step S333 in FIG. 11 is NO, i.e., when the required purge amount Q is less than zero, and thus it is assumed that the fuel vapor does not remain in the fuel adsorption layer 35 (35*a*, 35*b*) of the canister 30, control proceeds to step S336 in FIG. 12. At step S336, the heater is turned OFF, i.e., the heater plate 40 is deenergized. Then, control proceeds to step S337 where it is determined whether the IG is OFF. When the answer to the inquiry at step S337 is NO, i.e., when the internal combustion engine 1 is running, control proceeds to step S338. At step S338, the canister temperature T3 is read from the temperature sensor 49 arranged in the canister 30. Then, control proceeds to step S339 where the canister temperature T3 read at step S338 is equal to or greater than the predetermined canister temperature Ta. When the answer to the inquiry at step S339 is NO, i.e., when the canister temperature T3 is less than the predetermined temperature Ta, control returns to step S336 to repeat the corresponding operation.

On the other hand, when the answer to the inquiry at step S339 is YES, i.e., when the canister temperature T3 is equal to or greater than the predetermined canister temperature Ta, control returns to step S302 in FIG. 10 to repeat the corresponding operation. That is, when the heater plate 40 is deenergized, and the internal combustion engine 1 is running, the fuel vapor is guided into the canister 30 and is adsorbed and retained in the canister 30. At this time, the canister temperature T3 in the canister 30, which is now increased by the adsorption, is determined based on a predetermined canister temperature Ta to determine execution of another purge control. On the other hand, when the answer to the inquiry at step S337 is YES, i.e., when the internal combustion engine 1 is stopped, the purge control cannot be performed, so that control returns to step S317 in FIG. 10 to perform the corresponding operation.

As described above, the control means, which is embodied by the ECU 50 of the fuel vapor processing device of the internal combustion engine of the present embodiment, calculates the required purge amount Q based on the estimated canister adsorbed fuel amount M, which is calculated based on the temperature variation ΔT inside the canister 30, and controls activation and deactivation of the temperature adjusting means, which is embodied by the heater plate 40 and the ECU 50.

That is, the estimated canister adsorbed fuel amount M of the fuel vapor adsorbed and retained in the canister 30 is obtained based on the temperature variation ΔT between the canister temperature T1 and the canister temperature T2. Then, the required purge amount Q is calculated based on the estimated canister adsorbed fuel amount M. The energization of the heater plate 40 for promoting the purge is performed based on the required purge amount Q, so that the fuel vapor adsorbed and retained in the fuel adsorption layer 35 (35*a*, 35*b*) of the canister 30 is advantageously desorbed. In this way, the fuel vapor processing can be performed at appropriate timing.

Furthermore, control means, which is embodied by the ECU 50 of the fuel vapor processing device of the internal combustion engine of the present embodiment, deactivates or stops the temperature adjusting means, which is embodied by the heater plate 40 and the ECU 50, when the required purge amount Q calculated based on the estimated canister adsorbed fuel amount M is greater than the predetermined value Qb or when the required purge amount Q is substantially zero. Also, the control means activates the temperature adjusting means when the required purge amount Q is less than the predetermined amount Qb.

That is, when the required purge amount Q, which is calculated based on the estimated canister adsorbed fuel amount M, is greater than the predetermined amount Qb, the fuel vapor adsorbed and retained in the fuel adsorption layer 35 (35*a*, 35*b*) of the canister 30 tends to desorb from the fuel adsorption layer 35 (35*a*, 35*b*), so that the energization of the heater plate 40 is not required. Furthermore, when the required purge amount Q is substantially zero, the fuel vapor is not adsorbed and retained in the fuel adsorption layer 35 (35*a*, 35*b*) of the canister 30, so that the energization of the heater plate 40 is not required to save the energy. Other than these cases, i.e., when the required purge amount Q is less than the predetermined amount Qb, the fuel vapor adsorbed and retained in the fuel adsorption layer 35 (35*a*, 35*b*) of the canister 30 does not tend to desorb from the fuel adsorption layer 35 (35*a*, 35*b*), so that the heater plate 40 is energized to promote the purge. In this way, the fuel vapor processing can be performed at appropriate timing.

Additional advantages and modifications will readily occur to those skilled in the art. The invention in its broader terms is therefore, not limited to the specific details, representative apparatus, and illustrative examples shown and described.

What is claimed is:

1. A fuel vapor processing device for an internal combustion engine, the fuel vapor processing device comprising:

a canister that includes:

a case; and a fuel adsorption layer that is received in the case and includes an adsorption material for adsorbing fuel vapor, wherein one end of the case is communicated with a fuel vapor passage connected to a fuel tank and is also communicated with a purge passage connected to an intake passage of the internal combustion engine, and the other end of the case is communicated with the atmosphere;

a purge control means for:

enabling temporary adsorption and retainment of fuel vapor, which is released from the fuel tank to the fuel vapor passage, in the fuel adsorption layer; and enabling desorption and conduction of the fuel vapor from the fuel adsorption layer into the intake passage through the purge passage during operation of the internal combustion engine;

a temperature adjusting means for adjusting the temperature of the fuel adsorption layer; and an activation control means for controlling activation and deactivation of the temperature adjusting means based on an adsorbed amount of fuel vapor adsorbed and retained in the fuel adsorption layer;

wherein the activation control means calculates the adsorbed amount of fuel vapor based on the amount of fuel in the fuel tank to control activation and deactivation of the temperature adjusting means.

2. A fuel vapor processing device for an internal combustion engine, the fuel vapor processing device comprising:

a canister that includes:

a case; and a fuel adsorption layer that is received in the case and includes an adsorption material for adsorbing fuel vapor, wherein one end of the case is communicated with a fuel vapor passage connected to a fuel tank and is also communicated with a purge passage connected to an intake passage of the internal combustion engine, and the other end of the case is communicated with the atmosphere;

a purge control means for:

enabling temporary adsorption and retainment of fuel vapor, which is released from the fuel tank to the fuel vapor passage, in the fuel adsorption layer; and enabling desorption and conduction of the fuel vapor from the fuel adsorption layer into the intake passage through the purge passage during operation of the internal combustion engine;

a temperature adjusting means for adjusting the temperature of the fuel adsorption layer; and an activation control means for controlling activation and deactivation of the temperature adjusting means based on an adsorbed amount of fuel vapor adsorbed and retained in the fuel adsorption layer;

wherein the activation control means calculates the adsorbed amount of fuel vapor based on a non-operating time period of the internal combustion engine to control activation and deactivation of the temperature adjusting means.

3. A fuel vapor processing device for an internal combustion engine, the fuel vapor processing device comprising:

a canister that includes:

a case; and a fuel adsorption layer that is received in the case and includes an adsorption material for adsorbing fuel vapor, wherein one end of the case is communicated with a fuel vapor passage connected to a fuel tank and is also communicated with a purge passage connected to an intake passage of the internal combustion engine, and the other end of the case is communicated with the atmosphere;

a purge control means for:

enabling temporary adsorption and retainment of fuel vapor, which is released from the fuel tank to the fuel vapor passage in the fuel adsorption layer; and enabling desorption and conduction of the fuel vapor from the fuel adsorption layer into the intake passage through the purge passage during operation of the internal combustion engine;

a temperature adjusting means for adjusting the temperature of the fuel adsorption layer; and an activation control means for controlling activation and deactivation of the temperature adjusting means based on an adsorbed amount of fuel vapor adsorbed and retained in the fuel adsorption layer;

wherein the activation control means calculates the adsorbed amount of fuel vapor based on a temperature variation in the canister to control activation and deactivation of the temperature adjusting means.

4. A method for effecting an improved fuel vapor adsorption and purging process in connection with an internal combustion engine using a canister that includes a case containing fuel vapor adsorption material communicating with (a) a fuel tank vapor passage, (b) an engine intake fuel vapor purge passage and (c) the atmosphere, said method comprising:

enabling temporary adsorption and retainment of fuel vapor, which is released from the fuel tank to the fuel vapor passage, in the fuel adsorption material;

enabling desorption and conduction of the fuel vapor from the fuel adsorption material into the intake passage through the purge passage during operation of the internal combustion engine;

adjusting the temperature of the fuel adsorption material;

controlling activation and deactivation of the temperature adjusting step based on an adsorbed amount of fuel vapor adsorbed and retained in the fuel adsorption material;

wherein the activation controlling step includes calculating the adsorbed amount of fuel vapor based on the amount of fuel in the fuel tank to control activation and deactivation of the temperature adjusting step.

5. A method for effecting an improved fuel vapor adsorption and purging process in connection with an internal combustion engine using a canister that includes a case containing fuel vapor adsorption material communicating with (a) a fuel tank vapor passage, (b) an engine intake fuel vapor purge passage and (c) the atmosphere, said method comprising:

enabling temporary adsorption and retainment of fuel vapor, which is released from the fuel tank to the fuel vapor passage, in the fuel adsorption material;

enabling desorption and conduction of the fuel vapor from the fuel adsorption material into the intake passage through the purge passage during operation of the internal combustion engine;

adjusting the temperature of the fuel adsorption material;

controlling activation and deactivation of the temperature adjusting step based on an adsorbed amount of fuel vapor adsorbed and retained in the fuel adsorption material;

wherein the activation controlling step includes calculating an adsorbed amount of fuel vapor based on a non-operating time period of the internal combustion engine to control activation and deactivation of the temperature adjusting step.

6. A method for effecting an improved fuel vapor adsorption and purging process in connection with an internal combustion engine using a canister that includes a case containing fuel vapor adsorption material communicating with (a) a fuel tank vapor passage, (b) an engine intake fuel vapor purge passage and (c) the atmosphere, said method comprising:

enabling temporary adsorption and retainment of fuel vapor, which is released from the fuel tank to the fuel vapor passage, in the fuel adsorption material;

enabling desorption and conduction of the fuel vapor from the fuel adsorption material into the intake passage through the purge passage during operation of the internal combustion engine;

adjusting the temperature of the fuel adsorption material;

controlling activation and deactivation of the temperature adjusting step based on an adsorbed amount of fuel vapor adsorbed and retained in the fuel adsorption material;

wherein the activation controlling step includes calculating an adsorbed amount of fuel vapor based on temperature variation in the canister to control activation and deactivation of the temperature adjusting step.

* * * * *